US006551472B2

(12) United States Patent
Saito et al.

(10) Patent No.: US 6,551,472 B2
(45) Date of Patent: Apr. 22, 2003

(54) ELECTROFORMING APPARATUS

(75) Inventors: Eiji Saito, Tokyo (JP); Masatoshi Suzuki, Kanagawa (JP); Minoru Tazoe, Tokyo (JP); Makoto Ito, Kanagawa (JP); Yuji Segawa, Tokyo (JP)

(73) Assignee: Sony Corporation (JP)

( * ) Notice: Subject to any disclaimer, the term of this patent is extended or adjusted under 35 U.S.C. 154(b) by 22 days.

(21) Appl. No.: 09/879,153

(22) Filed: Jun. 13, 2001

(65) Prior Publication Data

US 2002/0023833 A1 Feb. 28, 2002

(30) Foreign Application Priority Data

Jun. 16, 2000 (JP) ..... P2000-185947

(51) Int. Cl.[7] ..... C25D 17/00; C25B 9/00; C25B 11/03

(52) U.S. Cl. ..... 204/212; 204/224 R; 204/263; 204/283; 204/DIG. 7

(58) Field of Search ..... 205/68, 70, 73, 205/79; 204/212, 224 R, DIG. 7, 263, 283

(56) References Cited

U.S. PATENT DOCUMENTS

| | | | | | |
|---|---|---|---|---|---|
| 4,269,669 | A | * | 5/1981 | Soby et al. | 204/275.1 |
| 4,359,375 | A | * | 11/1982 | Smith | 204/212 |
| 4,539,079 | A | * | 9/1985 | Okabayashi | 204/212 X |
| 5,597,460 | A | * | 1/1997 | Reynolds | 204/212 |
| 5,785,826 | A | * | 7/1998 | Greenspan | 204/212 |
| 5,833,828 | A | * | 11/1998 | Gubig | 205/68 |
| 5,976,329 | A | * | 11/1999 | Bock et al. | 204/212 |

FOREIGN PATENT DOCUMENTS

| | | |
|---|---|---|
| EP | 915 190 | 5/1999 |
| JP | 3-202485 | 9/1991 |
| JP | 5-59582 | 5/1993 |

* cited by examiner

*Primary Examiner*—Donald R. Valentine
(74) *Attorney, Agent, or Firm*—Rader, Fishman & Grauer PLLC; Ronald P. Kananen, Esq.

(57) ABSTRACT

An electroforming apparatus comprising a container unit for storing the plating solution, a cathode part placed in the container unit and for holding an object to-be-plated and an anode part placed in the container unit face-to-face with the cathode part, wherein a current-conductive opening of the anode part is formed to have an area larger than that of a current-conductive opening of the cathode part.

11 Claims, 12 Drawing Sheets

FIG. 9

| TOTAL CURRENT VALUE | OPTICAL DISC MASTER (Φ200mm GLASS) | TITANIUM BASKET |
|---|---|---|
| 140A | Φ185mm OPENING (2.68dm²)<br>52.2A/dm² | Φ300mm OPENING (7.06dm²)<br>19.8A/dm² |

FIG. 10

| TOTAL CURRENT VALUE | OPTICAL DISC MASTER (Φ200mm GLASS) | TITANIUM BASKET |
|---|---|---|
| 60A | Φ185mm OPENING (2.68dm²)<br>22A/dm² | Φ165mm OPENING (2.13dm²)<br>28A/dm² |

RELATION BETWEEN CURRENT DENSITY AND TIME REQUIRED

ELECTROFORMING APPARATUS

BACKGROUND OF THE INVENTION

1. Field of the Invention

This invention-relates to an electroforming apparatus for plating the surface of the object to be plated, such as an optical disc master.

2. Description of the Related Art

In the related art, an electroforming apparatus for plating an optical disc master made of glass, for instance, has a cathode part to place the optical disc master in a main tank for storing a plating solution. The cathode part has a surface on which the optical disc master is placed and is also equipped with a revolving mechanism for revolving the optical disc master placed on the cathode part surface.

A titanium basket, functioning as an anode part, is placed in the main tank face-to-face with the cathode part at a fixed distance. A plurality of nickel (Ni) balls is housed in the titanium basket.

Starting the electroforming apparatus of the above constitution permits predetermined current and voltage to be applied to a space between the titanium basket and the optical disc master for plating the surface of the optical disc master with nickel of a fixed coating thickness.

For example, the current and time for plating the surface of the optical disc master by the use of the above electroforming apparatus may be set as follows. That is, in case of subjecting an optical disc master of 200 mm in diameter, for instance, to plating of 290 to 300 $\mu$m in coating thickness, the electroforming apparatus first applies current to the surface of the optical disc master to provide a current density as low as 0.2 to 0.3 A/dm$^2$. Thereafter, the electroforming apparatus increases the current gradually in a period of 10 to 20 minutes, for instance, to increase the current density on the surface of the optical disc master up to 22 to 26 A/dm$^2$, for instance. Then, as the result of applying the current continuously for 70 to 80 minutes while keeping the above current density, the surface of the optical disc master is subjected to plating of 300 $\mu$m in coating thickness.

SUMMARY OF THE INVENTION

Incidentally, in addition to the plating process with the above electroforming apparatus, a cutting process or the like of forming pits or the like in the glass master original is required prior to the plating process for the manufacture of the optical disc master. Less process time has been required recently for cutting, permitting the cutting process to be finished in a period as short as about 30 minutes at present. Accordingly, there is a tendency toward the reduction in overall process time for the manufacture of the optical disc master. In this connection, less process time also is required for plating with the above electroforming apparatus.

In the above case, assuming that the current density on the surface of the optical disc master is increased up to 22 to 26 A/dm$^2$, there is a need for continuous application of current for 70 to 80 minutes to subject the optical disc master of 200 mm in diameter to plating of 290 to 300 $\mu$m in coating thickness.

The current density on the surface of the optical disc master has a relation to the time required, as shown in FIG. 15.

That is, an increase in current density on the surface of the optical disc master up to 50 A/dm$^2$ is good enough to finish plating the surface of the optical disc master with a coating thickness of 300 $\mu$m within 30 minutes.

However, if the current density on the surface of the optical disc master is increased up to about 50 A/dm$^2$, a passive state of metal occurs in the titanium basket placed face-to-face with the optical disc master. The phenomenon of generation of oxygen and the chlorine gas or the like resulting from the electric discharge of the hydroxide ion and chlorine ion in preference to melting of nickel (Ni) is referred to as the passive state.

The passive state, if it occurs, reduces the pH of the plating solution in the main tank to cause decomposition of the plating solution, resulting in a problem in that the optical disc master may not be plated as desired.

On the other hand, as the result of increasing the current density on the surface of the optical disc master up to about 50 A/dm$^2$, the temperature of the plating solution sometimes increases up to 70° C. or more in excess of a temperature of 50 to 55° C. in a normal condition of the plating solution, for instance, in the vicinity of the titanium basket where the plating solution is easily subjected to retention. An increase in temperature of the plating solution, as described above, causes decomposition of the plating solution as well, resulting in a problem in that the optical disc master may not be plated as desired.

It is an object of the present invention to provide an electroforming apparatus that permits plating enough to form a coating of high quality in a short period of time without causing decomposition of the plating solution.

To attain the above object, according to a first aspect of the present invention, there is provided an electroforming apparatus which comprises a container unit for storing a plating solution, a cathode part placed in the container unit and provided with an object to-be-plated, and an anode part placed in the container unit face-to-face with the cathode part, wherein a current-conductive opening of the anode part is formed to have an area larger than that of a current-conductive opening of the cathode part.

According to the above constitution, since the current-conductive opening of the anode part is formed to have an area larger than that of the current-conductive opening of the cathode part, the anode part permits less increase in current density than the cathode part, even if the current density of the cathode part is increased. Thus, no passive state occurs in the anode part, resulting in the prevention of the plating solution from being decomposed and so on.

Further, the anode part where the plating solution is easily subjected to retention permits less increase in current density than the cathode part, resulting in the prevention of the plating solution from being decomposed due to an increase in temperature as well.

Preferably, according to a second aspect of the present invention, the electroforming apparatus in the constitution as defined in the first aspect may be characterized in that the cathode part is placed in an inclined posture at a certain angle.

According to the above constitution, an inclined rotary-type electroforming apparatus having the cathode part placed in the inclined posture at the certain angle, for instance, may prevent the current density of the anode part from being increased as much as that of the cathode part, even if the current density of the cathode part is increased.

Preferably, according to a third aspect of the present invention, the electroforming apparatus in the constitution as defined in the second aspect is characterized in that the current-conductive opening of the anode part is formed to have an area two to three times or more as large as an area of the current-conductive opening of the cathode part.

According to the above constitution, since the current-conductive opening of the anode part is formed to have an area two to three times as large as the area of the current-conductive opening of the cathode part the current density of the anode part is limited to half or less of the current density of the cathode part, even if the current density of the cathode part is increased in particular. Thus, the passive state may be further prevented from occurring in the anode part, resulting in the effective prevention of the plating solution from being decomposed and so on.

Preferably, according to a fourth aspect of the present invention, the electroforming apparatus in the constitution as defined in the third aspect is characterized in that the anode part is formed as a titanium basket, and the electroforming apparatus further comprises a diaphragm and a shield plate respectively placed between the titanium basket and the object to-be-plated on the cathode part, a first piping part for feeding the plating solution to a space between the titanium basket, and the diaphragm and a second piping part for feeding the plating solution to a space between the cathode part and the shield plate.

According to the above constitution, since the electroforming apparatus further comprises the first piping part for feeding the plating solution to the space between the titanium basket and the diaphragm and the second piping part for feeding the plating solution to the space between the cathode part and the shield plate, the plating solution may be prevented from being retained, while the temperature of the plating solution may be prevented from increasing in the case of applying current, resulting in a more effective prevention of the plating solution from being decomposed.

Preferably, according to a fifth aspect of the present invention, the electroforming apparatus in the constitution as defined in the fourth aspect is characterized in that the titanium basket is formed at a distance of about 5 to 20 mm from the diaphragm, while the diaphragm is formed at a distance of about 10 to 30 mm from the shield plate.

According to the above constitution, since the titanium basket is formed at a distance of about 5 to 20 mm from the diaphragm, while the diaphragm is formed at a distance of about 10 to 30 mm from the shield plate, an increase in temperature of the plating solution resulting from the application of current may be controlled with accuracy, resulting in more effective prevention of the plating solution from being decomposed.

Preferably, according to a sixth aspect of the present invention, the electroforming apparatus in the constitution as defined in the fifth aspect is characterized in that the titanium basket is formed in the shape of a box as a whole, and at least the surface facing the cathode part out of the surfaces of the titanium basket comprises a meshed part.

Preferably, according to a seventh aspect of the present invention, the electroforming apparatus in the constitution as defined in the fourth aspect is characterized in that the shield plate has an opening in the center, while a outer periphery part having a plurality of holes is formed in the outer periphery of the opening.

According to the above constitution, since the shield plate has an opening in the center, while the periphery part having the plurality of punched holes is formed in the outer periphery of the opening, the current density of the cathode part may be increased largely without the need for increasing largely the current density of the anode part, while the object to be plated may be plated with a uniform coating thickness.

Preferably, according to a eighth the present invention, the electroforming apparatus in the constitution as defined in the first aspect is characterized in that the cathode part has a cap base to place the object to be plated and a cap to hold the object to be plated, and a ring-shaped member is placed between the object to be plated and the cap.

According to the above constitution, since the ring-shaped member is placed between the object to be plated and the cap, the contact area of the object to be plated with the ring-shaped member is increased to permit less breakage of the current-conductive coating formed on the object to be plated, resulting in less occurrence of defective conduction of current.

BRIEF DESCRIPTION OF THE DRAWINGS

The foregoing and other objects and features of the invention will become apparent from the following description of preferred embodiments of the invention with reference to the accompanying drawings, in which:

FIG. 9 shows the results of measurement of a current density on a current-conductive opening surface of the optical disc master and on a current-conductive opening surface of the titanium basket according to the present invention;

FIG. 10 shows the results of measurement of a current density on a current-conductive opening surface of the optical disc master and on a current-conductive opening surface of the titanium basket in the related art;

DETAILED DESCRIPTION OF PREFERRED EMBODIMENTS

Figure 1:
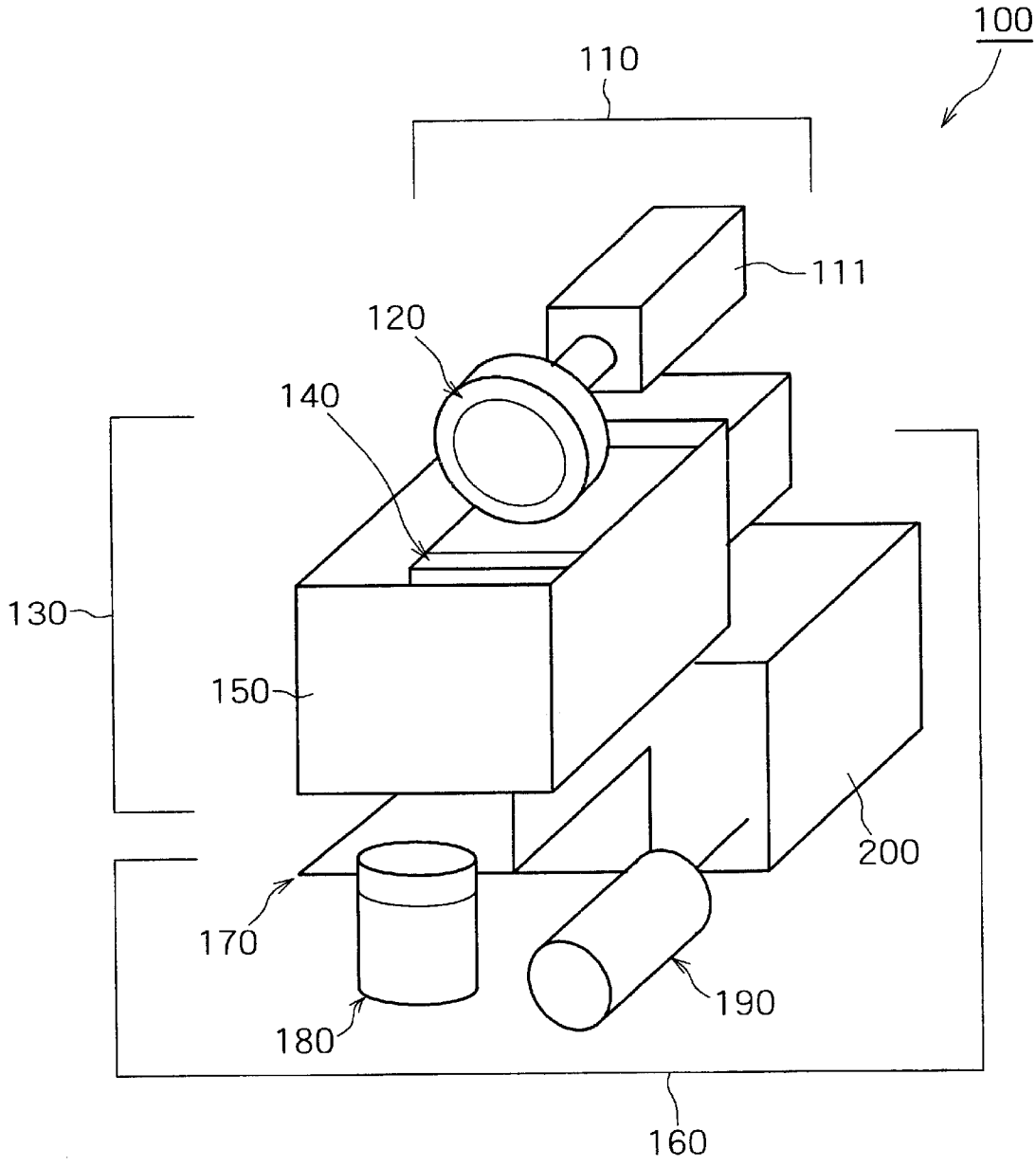
FIG. 1 is a schematic view showing an inclined rotary-type electroforming apparatus provided as an electroforming apparatus according to one embodiment of the present invention.

FIG. 1 is a schematic view showing an inclined rotary-type electroforming apparatus 100 provided as an electroforming apparatus according to one embodiment of the present invention. As shown in FIG. 1, the inclined rotary-type electroforming apparatus 100 comprises a rotary head part 110, a plating tank part 130 and a control tank part 160.

The rotary head part 110 has a cathode part 120 and uses a driver part 111 for revolution of the cathode part 120.

The plating tank part 130 has a main tank 150 functioning as a container unit for storing a plating solution and a titanium basket 140 functioning as an anode part placed in the main tank 150.

Further, the control tank part 160 has a control tank body 200 and is structured to supply the plating solution from the control tank body 200 to the main tank 150 through piping 170.

The piping 170 is provided with a filter 180 and a pump 190 for feeding the plating solution to the main tank 150.

Figure 2:
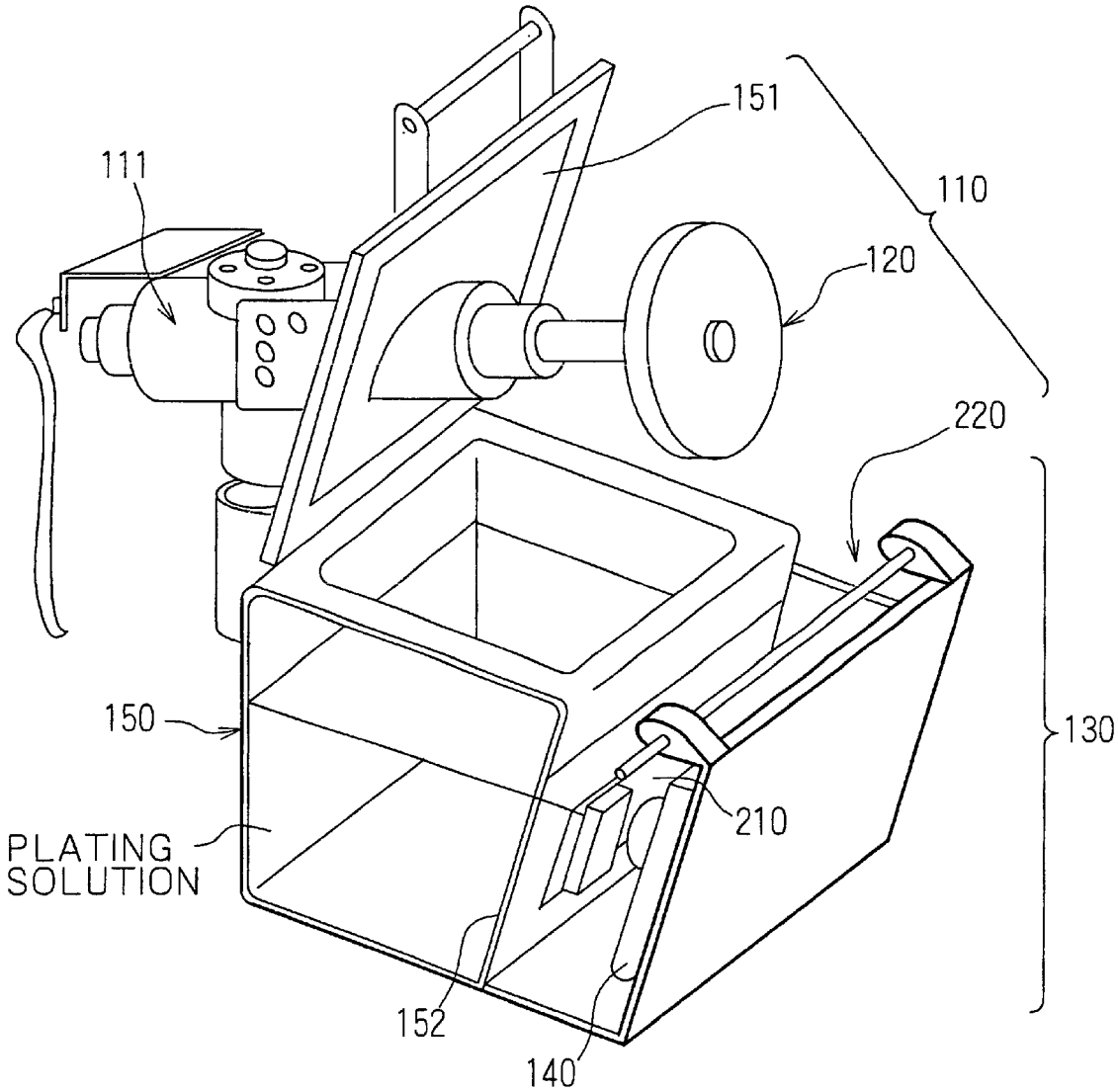
FIG. 2 is a perspective view showing the details of the rotary head part and the plating tank part in FIG. 1.

FIG. 2 is a perspective view showing the details of the rotary head part 110 and the plating tank part 130 in FIG. 1.

As shown in FIG. 2, the rotary head part 110 is installed to a cover 151 of the main tank 150. In this case, the driver part 111 having a motor for revolving the cathode part 120 and a current-conductive contact is placed on the outside of the cover 151, while the cathode part 120 is placed on the inside of the cover 151.

Covering the main tank 150 with the cover 151 provided with the rotary head part 110, as described above, sets the cathode part 120 in the main tank 150 in an inclined posture at an angle of about 45 degrees.

With the cathode part 120 placed in the inclined posture, gas or the like generated in the plating solution stored in the main tank 150 may escape easily toward the surface, resulting in the prevention of defective plating from occurring by the presence of gas or the like.

The cathode part 120 is revolved in the circumferential direction by the driver part 111, while the circumferential revolution permits the surface of an object to be plated, such as an optical disc master placed on the cathode part 120, to be plated with a uniform coating thickness.

Incidentally, the titanium basket 140 is placed in the main tank 150 for storing the plating solution through a bulkhead 152. Nickel (Ni) balls or the like are disposed in the titanium basket 140, and the surface facing the cathode part 120 out of the surfaces of the titanium basket is formed in the shape of reticulated meshes.

A shield plate 210 for adjustment of current distribution and a bar 220 or the like for conduction of current to the titanium basket are provided in the vicinity of the titanium basket 140.

Figure 3:
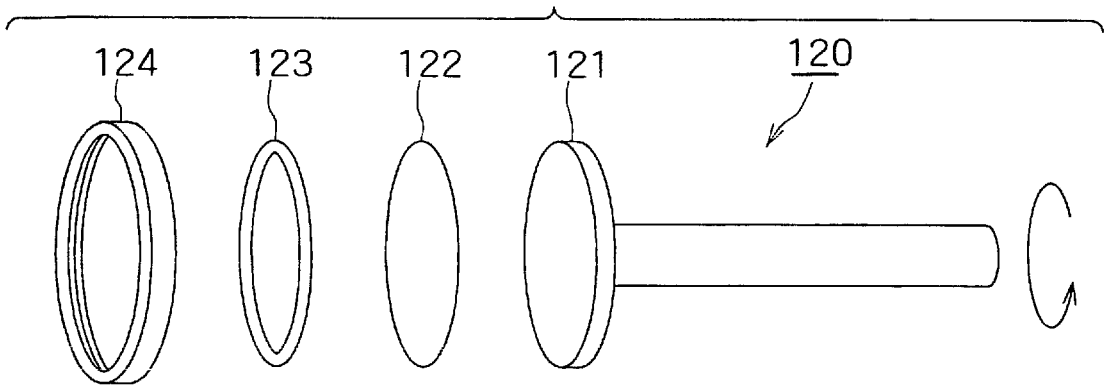
FIG. 3 is an exploded perspective view showing the specific constitution of the cathode part in FIG. 2.

FIG. 3 is an exploded perspective view showing the specific constitution of the cathode part 120 in FIG. 2.

As shown in FIG. 3, the cathode part 120 has a cap base 121 permitting the conduction of current to a cap 124 as will be described later, while holding an optical disc master 122 made of glass, as will be described later. The cap base 121 is revolved in the direction shown by the arrow in FIG. 3 with the motor or the like of the driver part 111.

The optical disc master 122 made of glass, for instance, as the object to-be-plated is mounted to the circular surface of the cap base 121. The optical disc master 122 is formed to be about 200 mm in diameter, for instance.

A current-conductive ring 123 is provided as a ring-like member in contact with the peripheral edge of the optical disc master 122. Specifically, the current-conductive ring 123 is formed to be 8 to 12 mm in width and 0.2 to 0.5 mm in thickness, and its material may comprise metal such as SUS304 and 316, for instance.

The optical disc master 122 is held in close contact with the cap base 121 by the cap 124 through the current-conductive ring 123. Further, current is conducted to the surface of the optical disc master 122 through the cap 124 and the current-conductive ring 123 on each occasion of conduction of current.

Figure 4A:
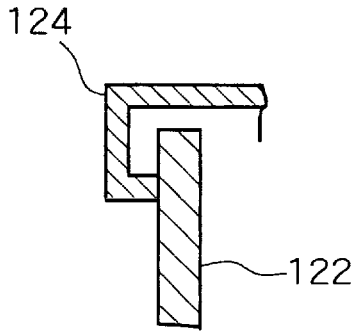
FIG. 4A is a view illustrating the relation between a cap and an optical disc master in the related art.

Incidentally, it is to be understood that the current-conductive ring 123 was nonexistent in the cathode part of the electroforming apparatus in the related art. FIG. 4A shows the state of contact between the optical disc master 122 and the cap 124 of the cathode part in the related art. As shown in FIG. 4A, since the end of the cap 124 is merely in contact with the optical disc master 122 in the related art, breakage of the current-conductive coating occurs from a contact portion between the optical disc master 122 and the cap 124, assuming that an increase in current up to a current value of 140 A (current density of 50 A/dm$^2$) is required, for instance, in a period of 10 minutes for plating, resulting in the problem of defective conduction of current. To solve this problem, there has been no other way than that of expending a time longer than 10 minutes upon an increase in current.

Figure 4B:
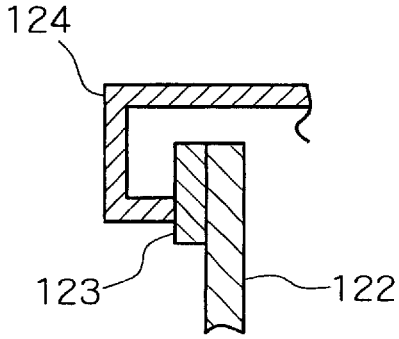
FIG. 4B is a view illustrating the relation among the cap, the current-conductive ring and the optical disc master in FIG. 3.

On the other hand, according to one embodiment of the present invention, the cap 124 is in contact with the optical disc master 122 through the current-conductive ring 123, as shown in FIG. 4B. Thus, the area of contact of the cap with the optical disc master 122 is made larger, as compared with the related art.

Accordingly, even when the current is increased up to a current value of 140 A (current density of 50 A/dm$^2$) in a period of 3 to 4 minutes, for instance, no breakage of the current-conductive coating occurs from the contact portion between the optical disc master 122 and the current-conductive ring 123, resulting in the prevention of defective conduction of current. Thus, plating in a short period of time, when made possible, permits a reduction in overall process time for the manufacture of the optical disc master as well.

Figure 5:
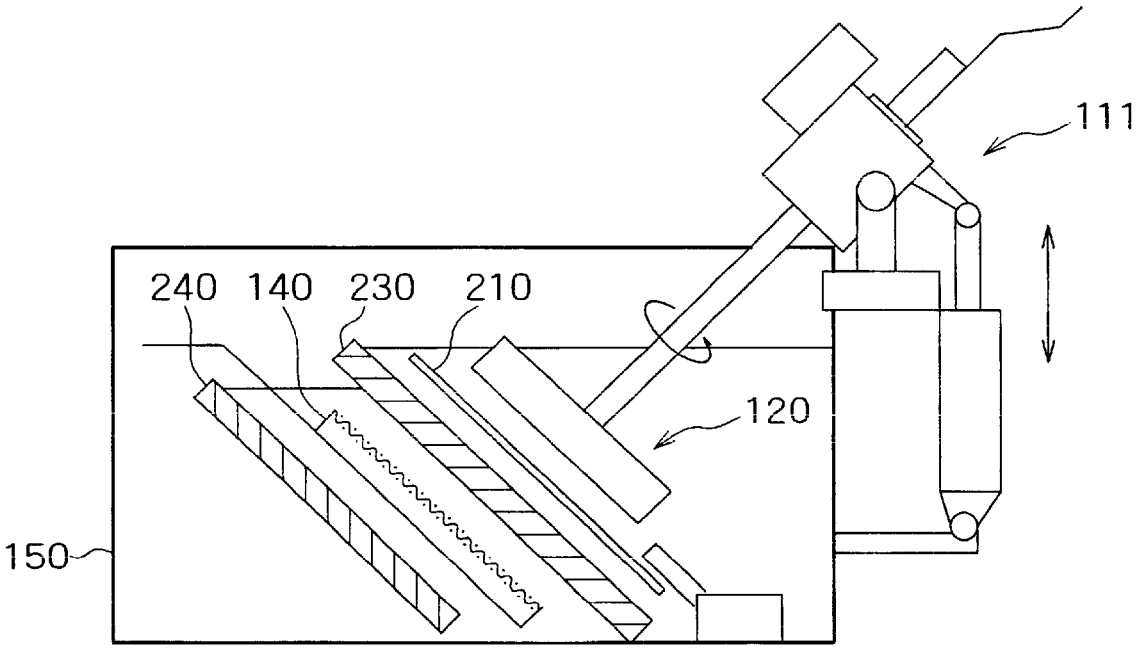
FIG. 5 is a schematic sectional view showing the state of the cathode part of FIG. 4 placed in the main tank of FIG. 2.

FIG. 5 shows the state of the above cathode part 120 placed in the main tank 150 in FIG. 2.

As shown in FIG. 5, the above shield plate 210 for adjustment of current distribution is placed at a fixed distance, that is, a distance of 30 to 35 mm, for instance, from the cathode part 120.

Figure 6:
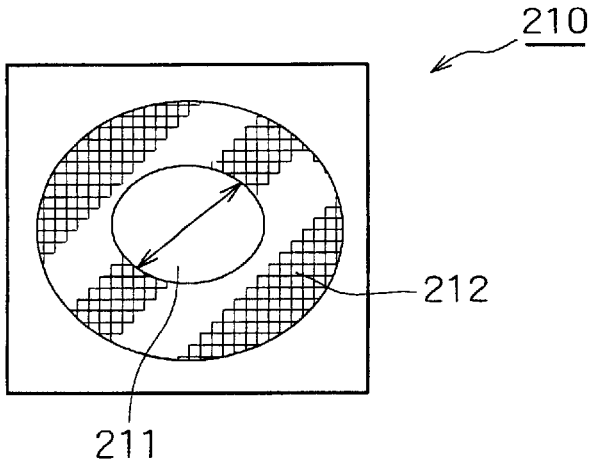
FIG. 6 is a schematic view showing a shield plate.

As shown in FIG. 6, the shield plate 210 has a current-conductive opening 211 in the center, and this current-conductive opening 211 is formed to be 120 to 140 mm in diameter or major axial length, for instance. Further, a mesh-like opening 212 is provided as a punched hole part in the outer periphery of the current-conductive opening 211. The mesh-like opening is formed to be 300 mm in diameter or major axial length, for instance.

The mesh-like opening 212 is equal in diameter or major axial length with the opening of a diaphragm 230, as will be described later.

The diaphragm 230 is placed on the left side of the shield plate 210 in FIG. 5 at a distance of 10 to 30 mm, for instance. When the nickel balls housed in the titanium basket 140 placed on the left side of the diaphragm in FIG. 5 are melted into nickel sludge, the diaphragm 230 functions as a weir for preventing the nickel sludge from being scattered.

Figure 7:
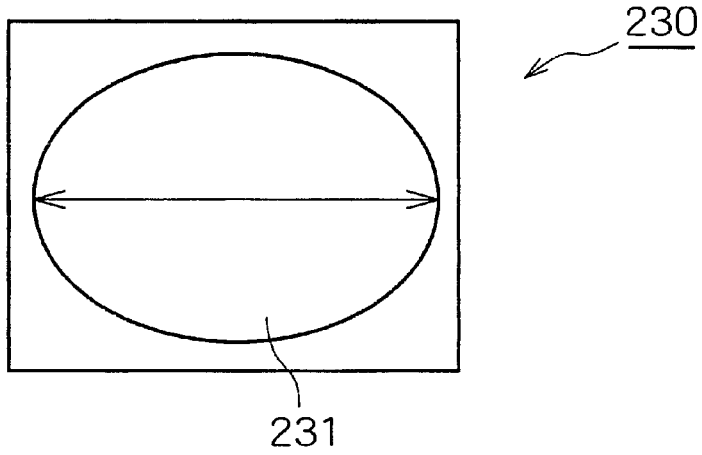
FIG. 7 is a schematic view showing a diaphragm.

Specifically, the diaphragm 230 has an opening 231 in the center, as shown in FIG. 7, and the opening 231 is formed to be 300 mm in diameter or major axial length, for instance, similarly to the mesh-like opening 212 of the shield plate 210.

Figure 8:
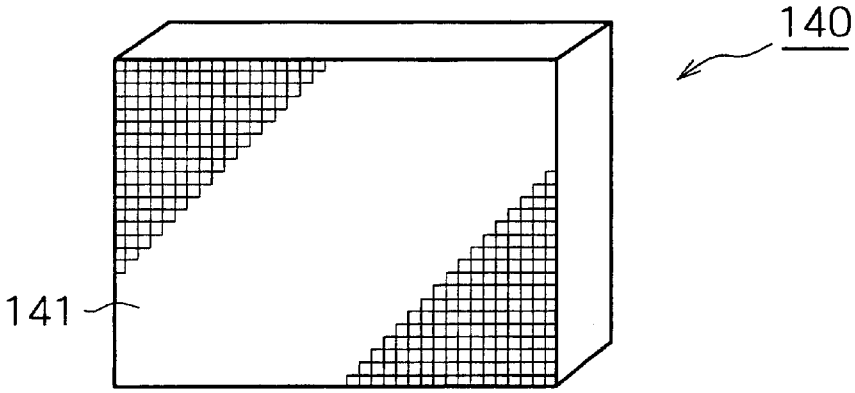
FIG. 8 is a schematic view showing a titanium basket.

Further, the titanium basket 140 is placed on the left side of the diaphragm 230 in FIG. 5 at a distance of 5 to 20 mm. FIG. 8 shows the specific constitution of the titanium basket 140.

That is, the titanium basket 140 is formed in the shape of a box as a whole, and its front face 141 on the side of the diaphragm 230 has a reticulated mesh part. Further, sulfamic acid nickel in the shape of balls is stored in the titanium basket 140, for instance.

Incidentally, according to the above embodiment of the present invention, the diaphragm 230 is provided on the side of the front face 141 of the titanium basket 140, and the shield plate 210 is placed face-to-face with the diaphragm. That is, the openings in the mesh part on the front face 141 of the titanium basket 140 are firstly shielded with the diaphragm 230. However, it is to be understood that the diaphragm 230 has the opening 231 of 300 mm in diameter or major axial length in the center, while the shield plate 210 placed face-to-face with the diaphragm 230 has the opening part of 300 mm in diameter or major axial length resulting from summing up the current-conductive opening 211 in the center and the mesh-like opening 212.

The above diameter or major axial length of 300 mm is applied to the criterion of the area of the current-conductive opening on the anode side (i.e., the side of the titanium basket 140).

On the other hand, the optical disc master 122 in the cathode part 120 is 200 mm in diameter, as described the above, and the peripheral edge of the optical disc master is covered with the cap 124 and the current-conductive ring 123 so that the diameter of the current-conductive opening of the cathode part is reduced to about 185 mm, which is then applied to the criterion of the area of the current-conductive opening.

It is now evident that the area of the current-conductive opening on the anode side is judged to be larger by comparison between the diameter or major axial length of 300 mm applied to the criterion of the area of the current-conductive opening on the anode side and the diameter of 185 mm applied to the criterion of the area of the current-conductive opening on the cathode side. Further, the area of the current-conductive opening on the anode side needs to be two to three times in area ratio as large as the area of the current-conductive opening on the cathode side, in consideration of quality control, stabilization of the products or practicability of the apparatus.

FIG. 9 shows the results of measurement of the current density on the current-conductive opening surface of the optical disc master 122 and on the current-conductive opening surface of the titanium basket 220 through the application of current to the inclined rotary-type electroforming apparatus 100 having the above constitution.

As shown in FIG. 9, even when the current of 140A as the total current value is applied to increase the current density on the surface of the optical disc master 122 up to 52.2 $A/dm^2$, the current density on the surface of the titanium basket 140 is limited to 19.8 $A/dm^2$, without reaching 50 $A/dm^2$, which is the current density causing the passive state in the nickel balls on the side of the titanium basket 140. Thus, a reduction in pH of the plating solution does not occur, resulting in the prevention of the plating solution from being decomposed.

Figure 15:
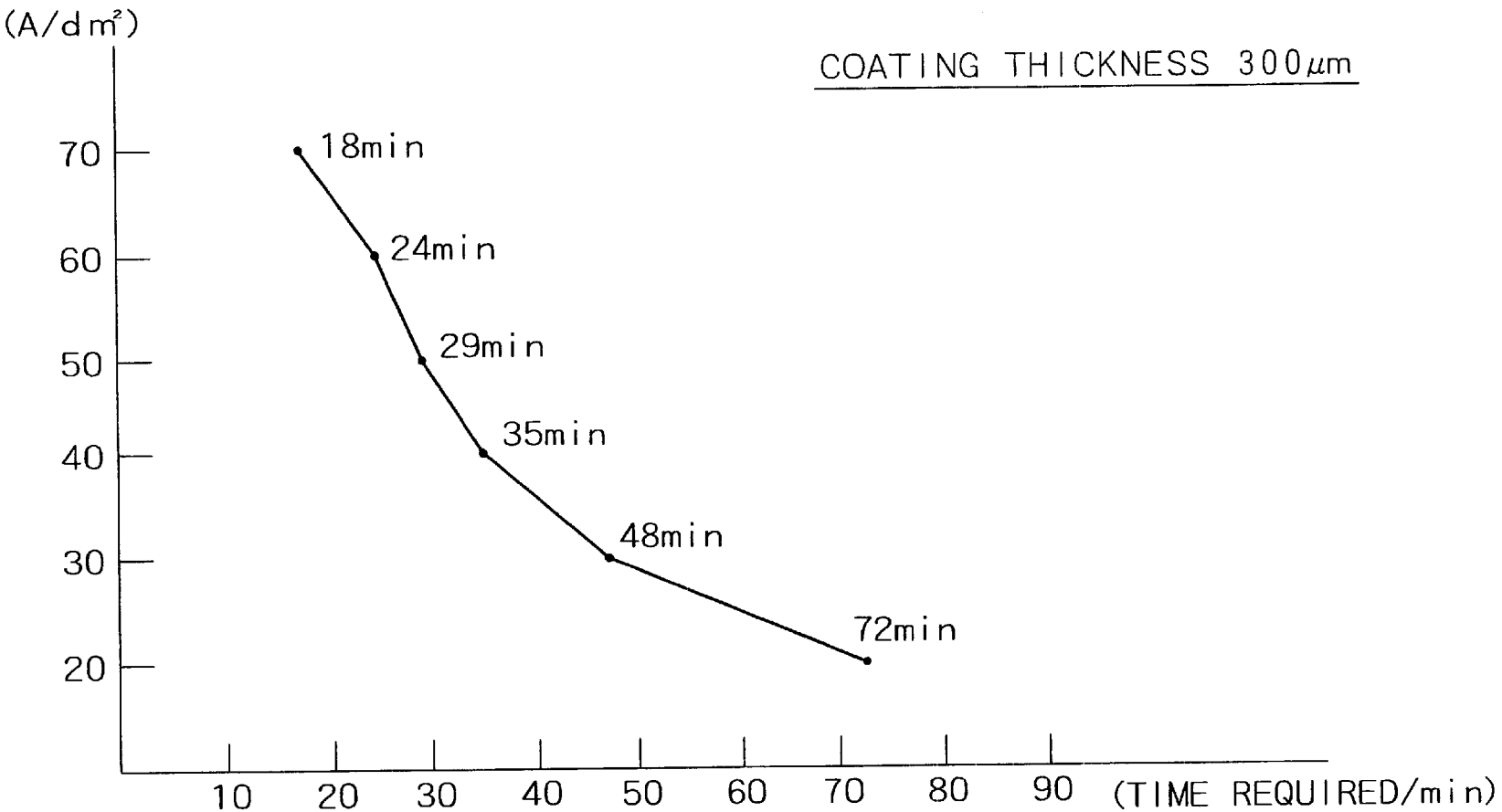
FIG. 15 is a graphical representation of the relation between current density and time required.

Further, since the current density on the surface of the optical disc master 122 may be increased up to 50 $A/dm^2$, as described the above, plating of 300 $\mu$m in coating thickness is made possible in a period as short as 30 minutes, as shown in FIG. 15.

Furthermore, in the above embodiment, since the titanium basket 140 is placed at a fixed distance from the diaphragm 230, which is also placed at a fixed distance from the shield plate 210, the current runs well when applied to the inclined rotary-type electroforming apparatus 100, permitting plating of fixed coating thickness easily at high speed.

On the other hand, the diaphragm in the related art is united with the shield plate so that the opening in the center of the diaphragm is reduced to 160 to 170 mm in major axial length or diameter. Thus, it is evident that the opening area is judged to be smaller by comparison with the diameter of 185 mm applied to the criterion of the opening area of the optical disc master.

FIG. 10 shows the results of measurement of the current density on the surface of the titanium basket in the related art having the above opening area and on the surface of the optical disc master.

As shown in FIG. 10, with the increasing current density on the surface of the optical disc master up to 22 $A/dm^2$ through the application of current of 60A as the total current value, the current density on the surface of the titanium basket also increases up to 28 $A/dm^2$.

Thus, in the related art, when the current density on the surface of the optical disc master is increased up to about 50 $A/dm^2$, as much as the case of increasing the current density on the optical disc master 122 in the above embodiment, the current density of the titanium basket exceeds 50 $A/dm^2$ to cause the above passive state of nickel, resulting in a possibility of decomposition of the plating solution.

On the other hand, the inclined rotary-type electroforming apparatus 100 according to the above embodiment is different from the electroforming apparatus in the related art in that the current density on the surface of the optical disc master 122 may be increased up to 52.2 $A/dm^2$, while the current density on the surface of the titanium basket 140 may be limited to 19.8 $A/dm^2$, permitting plating at high speed without causing decomposition of the plating solution.

Incidentally, in the electroforming apparatus in the related art, when the current density on the surface of the optical disc master is increased up to about 50 $A/dm^2$ for the plating of a large coating thickness in a short period of time, the thick coating on the surface of the optical disc master is subjected to variation, resulting in an increase in stress in electrodeposition.

On the other hand, in the electroforming apparatus according to the above embodiment, the mesh-like opening 212 is provided in the outer periphery of the current-conductive opening 211, as shown in FIG. 6, the current-conductive opening of the shield plate 210 is limited to 125. mm in major axial length or diameter, and the cathode part 120 is distant 60 mm from the titanium basket 140 while being distant 30 to 35 mm from the shield plate 210.

Thus, the electroforming apparatus according to the above embodiment permits plating in the range of 295±5 $\mu$m in coating thickness in a required coating area of 40 to 140 mm in diameter on the surface of the optical disc master 122.

Incidentally, the electroforming apparatus in the related art presents a problem in that pits or lumps occur frequently on the surface of the thick coating on the surface of the optical disc master. On the other hand, in the above embodiment, since a pit-proof agent is added in the plating solution, the pits or lumps may be prevented from occurring on the surface of the thick coating.

As shown in FIG. 5, the weir 240 is provided on the left side of the titanium basket 140 in FIG. 5 to prevent the plating solution from overflowing, and a discharge opening and a nozzle also are provided to lead the plating solution to the inside of the main tank 150 through the piping 170 shown in FIG. 1.

Figure 11:
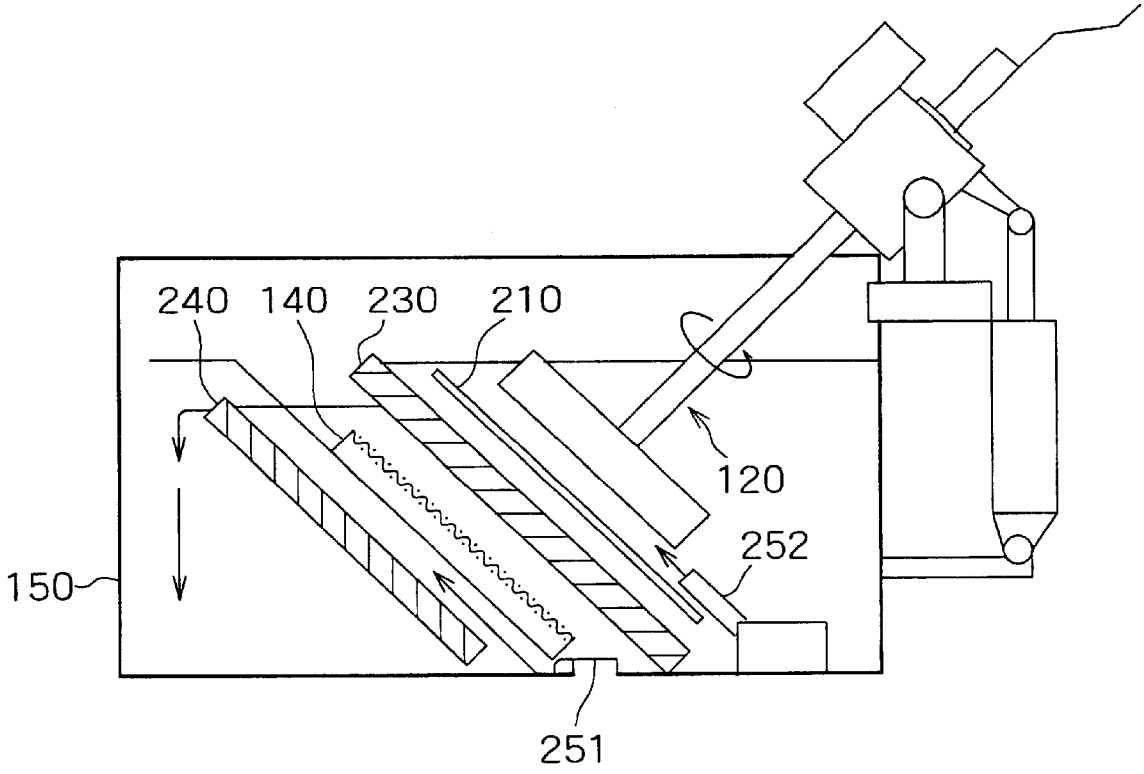
FIG. 11 is a schematic view showing the position of the nozzle or the like in FIG. 5.

That is, FIG. 11 shows the position of the nozzle or the like in FIG. 5. The electroforming apparatus of the above embodiment is different from the electroforming apparatus in the related art in that the discharge opening 251 is placed between the titanium basket 140 and the diaphragm 230. The nozzle 252 is provided between the cathode part 120 and the shield plate 210.

The plating solution supplied through the discharge opening 251 placed as described above flows through a space between the titanium basket 140 and the diaphragm 230 and also a space between the titanium basket 140 and the weir 240 to the left side of the weir 240, in FIG. 11 after overflowing through the weir 240 as shown by arrows in FIG. 11. The flow rate in the discharge opening 251 is limited to 5 to 20 lit./min., for instance.

On the other hand, the nozzle 252 is placed to allow the plating solution to flow through a space between the cathode part 120 and the shield plate 210.

The electroforming apparatus of the above embodiment is different from the related art in that the discharge opening 251 is provided in the vicinity of the titanium basket 140 where the plating solution is easily subjected to retention in particular, thus permitting acceleration of plating solution circulation in the vicinity of the titanium basket 140. Thus, the temperature of the plating solution resulting from the application of current may be prevented from remarkably increasing up to 70° C. or more, as against 50 to 55° C. in a normal condition, in the vicinity of the titanium basket 140.

When the temperature of the plating solution reaches 70° C. or more, decomposition of the plating solution occurs, particularly in the case of using sulfamic acid nickel, resulting in defective plating.

In this connection, the discharge opening 251 prevents the plating solution from being decomposed.

Figure 12:
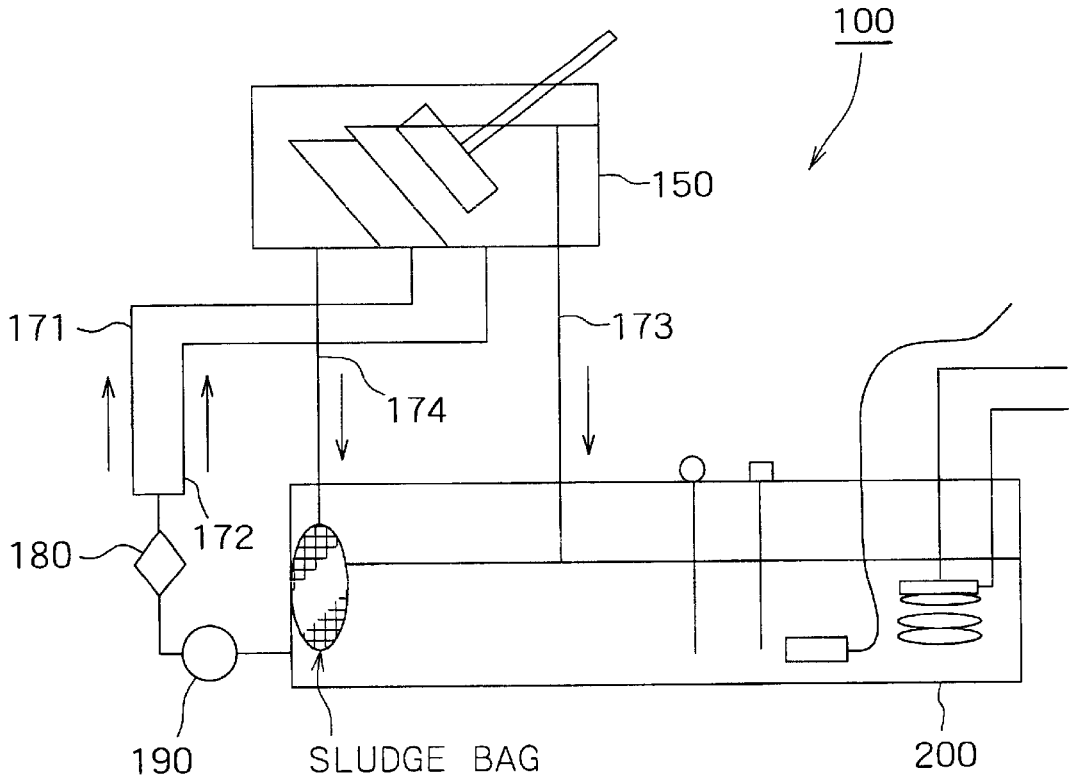
FIG. 12 is a schematic view showing a plating-solution circulation structure.

The plating solution supplied to the discharge opening 251 and the nozzle 252 is put into circulation as shown in FIG. 12.

That is, the plating solution stored in the control tank part 200 is branched off into a first piping part 171 and a second piping part 172 by the action of the pump 190 connected to the control tank part 200 after having been filtered through the filter 180.

The first piping part 171 is connected as a cooling pipe for the titanium basket 140 to the discharge opening 251 provided in the main tank 150.

On the other hand, the second piping part 172 is connected to the nozzle 252 in the main tank 150.

The plating solution having been led into the main tank 150 is returned from the main tank 150 to the control tank body 200 through an overflow pipe 173. The electroforming apparatus of the above embodiment is different from the electroforming apparatus in the related art in that a return pipe 174 is required for smoother circulation of the plating solution.

A description will now be given of the operation or the like of the inclined rotary-type electroforming apparatus 100 according to the above embodiment, as follows.

First, an operator injects a fixed quantity of plating solution in the control tank body 200 of FIG. 12 into the main tank 150 of the inclined rotary-type electroforming apparatus 100. The pit-proof agent is contained in the plating solution in advance, and the temperature of the plating solution is set at 60° C. in a normal condition, while being increased up to 62 to 64° C. resulting from the conduction of current.

Subsequently, the operator places the optical disc master 122 as the object to-be-plated on the cap base 121 of the cathode part 120 in the state shown in FIG. 2 to mount the cap 124 to the cap base through the current-conductive ring 123.

Consequently, the optical disc master 122 is mounted to the cathode part 120. In this state, the cathode part 120 is placed in the main tank 150, as shown in FIG. 5.

Figure 13:
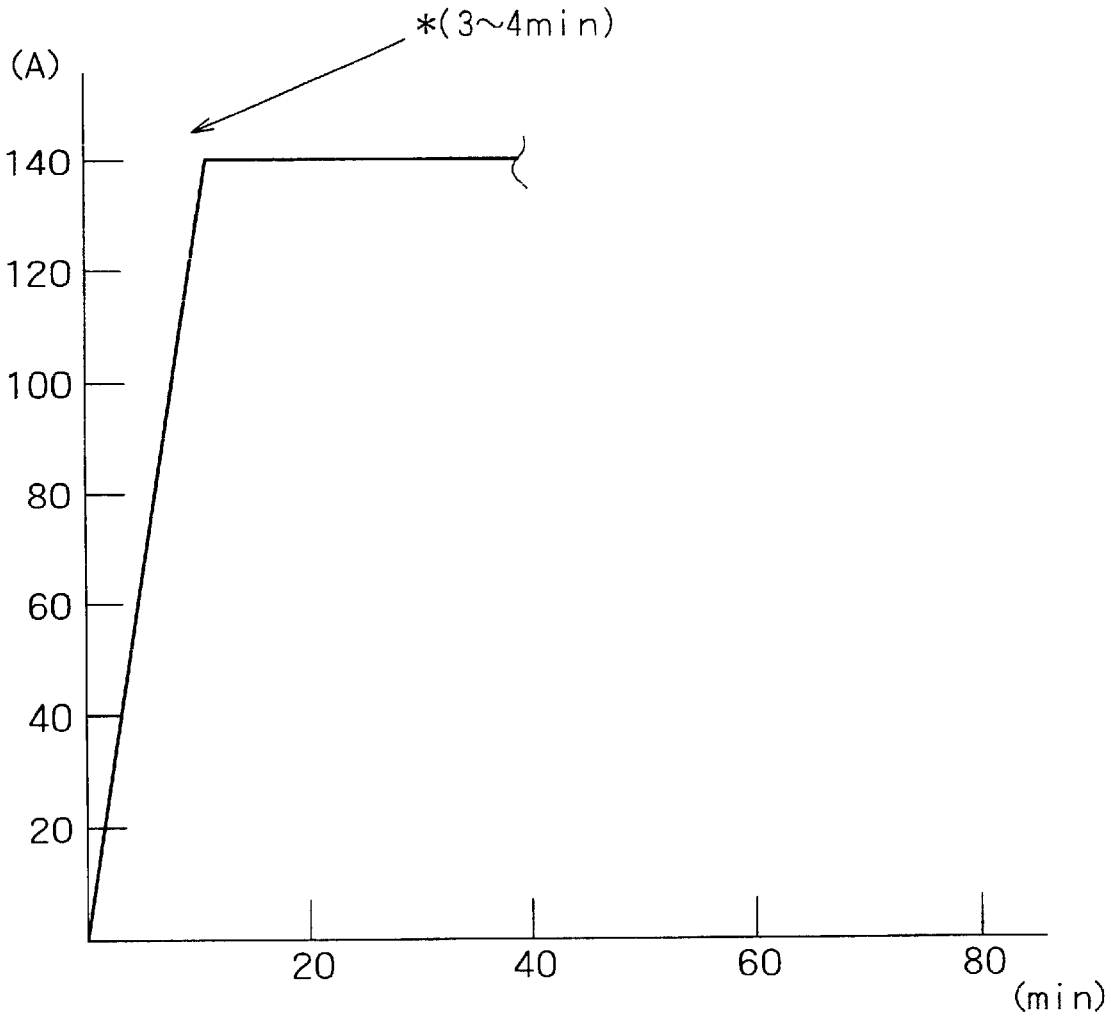
FIG. 13 is a graphical representation of the relation between current and plating time.

Then, the operator activates the inclined rotary-type electroforming apparatus 100 through other predetermined operations. Simultaneously with the activation, the application of current is started. As shown in FIG. 13, the total current value reaches 140A after the lapse of 3 to 4 minutes from starting.

Here, since the titanium basket 140 is formed to have an anode-side opening area two to three times as large as the opening area of the cathode part 120, the current density on the surface of the optical disc master 122 is increased up to 52.2 A/dm$^2$, whereas the current density on the surface of the titanium basket 140 is limited to 19.8 A/dm$^2$, as shown in FIG. 9.

Thus, the sulfamic acid nickel balls stored in the titanium basket 140 do not cause the passive state described above, resulting in no possibility of decomposition of the plating solution.

Further, the cap base 121 of the cathode part 120 is revolved in the direction shown by an arrow in the FIG. 5 with the driver part 111 while being placed in the current conduction state, permitting a plating of uniform coating thickness.

Further, in the above embodiment, the current-conductive opening 211 of the shield plate 210 is limited to 125 mm in major axial length or diameter, for instance, and the cathode part 120 is 60 mm from the titanium basket 140 and 30 to 35 mm from the shield plate 210. In addition, the mesh-like opening 212 having a large number of punched holes is formed in the outer periphery of the current-conductive opening 211 of the shield plate 210, permitting plating in the range of 295±5 $\mu$m in coating thickness in the required coating area of 40 to 140 mm in diameter on the surface of the optical disc master 122.

As shown in FIG. 13, after the current value reaches 140A, the current continues to be applied for 27 minutes 30 seconds, for instance, while keeping the above current value. Then, the surface of the optical disc master 122 may be plated with a coating thickness of 300 $\mu$m, as shown in FIG. 15. As shown in FIG. 12, since the plating solution is subjected to circulation through the control tank body 200 and the main tank 150 for 27 minutes 30 seconds, defective plating may be prevented from occurring due to retention of the plating solution.

Further, since the plating solution is discharged from the main tank 150 through the discharge opening 251 to the vicinity of the titanium basket 140, the temperature of the plating solution in the vicinity of the titanium basket 140 may be prevented effectively from increasing. Particularly, while the sulfamic acid nickel stored in the titanium basket 140 is so easily affected by temperature, the above embodiment permits easy control of temperature to meet the need for holding the plating solution at a temperature of not more than 65° C.

Furthermore, since the titanium basket 140, the diaphragm 230 and the shield plate 210 or the like are placed in the main tank 150 at a fixed distance, the current runs well, permitting easily more highly accurate plating.

Removing the optical disc master 122 from the cathode part 120 after the surface of the optical disc master 122 is plated with a coating thickness of 300 μm brings a series of operations to an end.

According to the inclined rotary-type electroforming apparatus 100 of the above embodiment, the optical disc master 122 may be plated uniformly with a high-quality coating thickness of 300 μm in a period as short as 27 minutes 30 seconds, permitting a substantial reduction in overall process time for the manufacture of the optical disc master. The above embodiment also permits improvement in the quality of the manufactured optical disc master.

It is to be understood that the above embodiment has been described by taking the case of a metal master, while a mother or stamper serving as a nickel metal master may be applied as well.

Figure 14:
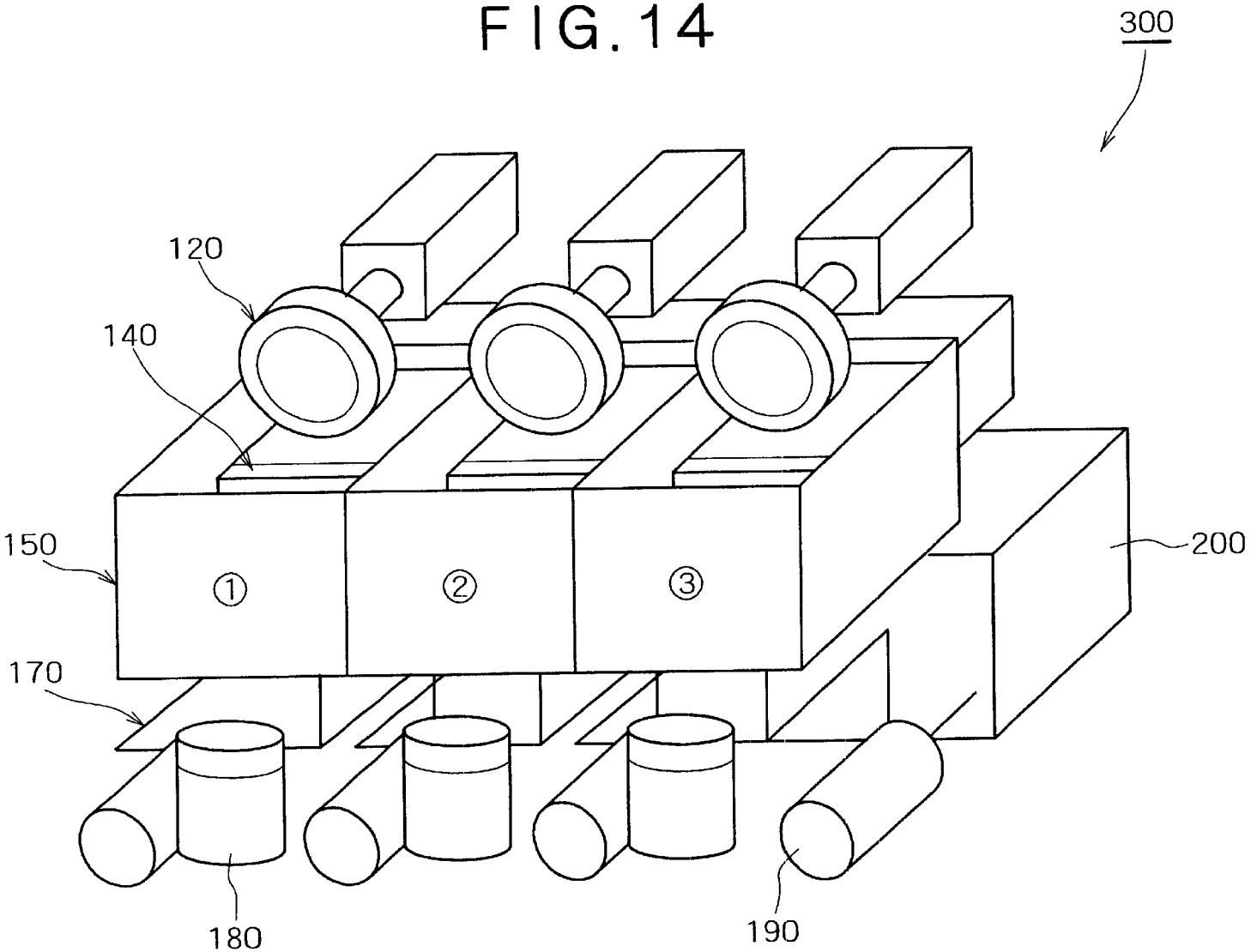
FIG. 14 is a view showing a modification of one embodiment according to the present invention.

FIG. 14 is a view showing an inclined rotary-type electroforming apparatus. 300 according to a modification of the above embodiment.

The electroforming apparatus 300 according to this modification comprises three inclined rotary-type electroforming apparatuses 100 arranged in rows, permitting higher improvement on the plating productivity of the optical disc master or the like.

While three inclined rotary-type electroforming apparatuses 100 merely arranged in rows are shown in FIG. 14, other constitutions also may be applied to the electroforming apparatus 300, such as uniting the control tanks into one, while installing more main tanks.

As has been described in the foregoing, according to the present invention, there may be provided an electroforming apparatus that permits enough plating to form a high-quality coating in a short period of time without causing decomposition of the plating solution.

It is to be understood that a partial omission of the constitution of the above embodiments or alterations of the above constitution into any other arbitrary combination also are possible.

What is claimed is:

1. An electroforming apparatus, comprising:

a container unit for storing a plating solution;

a cathode part placed in said container unit for holding an object to-be-plated; and an anode part placed in said container unit facing with said cathode part, wherein a current-conductive opening of said anode part is formed to have an area larger than that of a current-conductive opening of said cathode part;

wherein said cathode part is placed in an inclined posture at a certain angle;

wherein the current-conductive opening of said anode part is formed to have an area within a range between two and three times as large as that of the current-conductive opening of said cathode part;

wherein said anode part comprises a titanium basket, and said electroforming apparatus further comprises:

a diaphragm and a shield plate respectively placed between said titanium basket and the object to-be-plated on said cathode part;

a first piping part for feeding a plating solution to a space between said titanium basket and said diaphragm; and a second piping part for feeding the plating solution to a space between said cathode part and said shield plate; and wherein said shield plate has an opening in the center, and a punched hole part having a plurality of punched holes is formed in the outer periphery of said opening.

2. The electroforming apparatus according to claim 1, wherein said cathode part is placed in an inclined posture at a certain angle.

3. The electroforming apparatus according to claim 2, wherein the current-conductive opening of said anode part is formed to have an area within a range between two and three times as large as that of the current-conductive opening of said cathode part.

4. The electroforming apparatus according to claim 3, wherein said anode part comprises a titanium basket, and said electroforming apparatus further comprising:

a diaphragm and a shield plate respectively placed between said titanium basket and the object to-be-plated on said cathode part;

a first piping part for feeding a plating solution to a space between said titanium basket and said diaphragm; and a second piping part for feeding the plating solution to a space between said cathode part and said shield plate.

5. The electroforming apparatus according to claim 4, wherein said shield plate has an opening in the center, and a punched hole part having a plurality of punched holes is formed in the outer periphery of said opening.

6. The electroforming apparatus according to claim 1, wherein said titanium basket is disposed at a distance within a range between 5 mm and 20 mm from said diaphragm, while said diaphragm is disposed at a distance of within a range between 10 mm and 30 mm from said shield plate.

7. The electroforming apparatus according to claim 6, wherein said titanium basket is formed in a box shape, and at least the surface facing said cathode part out of the surfaces of said titanium basket is formed in a mesh shape.

8. The electroforming apparatus according to claim 1, wherein said cathode part has a cap base to place the object to-be-plated, a cap to hold the object to-be-plated, and a ring-shaped member placed between the object to-be-plated and said cap.

9. The electroforming apparatus according to claim 8, wherein the ring shaped member has a thickness of about 8 to 12 mm.

10. The electroforming apparatus according to claim 8, wherein the ring has a width of about 0.2 to 0.5 mm.

11. The electroforming apparatus according to claim 1, further comprising a motor connected to said cathode part and adapted to rotatably drive said cathode part.

* * * * *